US009163482B2

(12) United States Patent
Kanstad et al.

(10) Patent No.: US 9,163,482 B2
(45) Date of Patent: Oct. 20, 2015

(54) SUBSEA SYSTEM WITH SUBSEA COOLER AND METHOD FOR CLEANING THE SUBSEA COOLER

(75) Inventors: Stig Kare Kanstad, Fana (NO); Asmund Valland, Agotnes (NO); Nils-Egil Kangas, Nesttun (NO); Atle Berle, Ulset (NO)

(73) Assignee: Framo Engineering AS, Bergen (NO)

( * ) Notice: Subject to any disclaimer, the term of this patent is extended or adjusted under 35 U.S.C. 154(b) by 874 days.

(21) Appl. No.: 13/259,836

(22) PCT Filed: Mar. 29, 2010

(86) PCT No.: PCT/NO2010/000118

§ 371 (c)(1), (2), (4) Date: Dec. 27, 2011

(87) PCT Pub. No.: WO2010/110674

PCT Pub. Date: Sep. 30, 2010

(65) Prior Publication Data

US 2012/0103621 A1 May 3, 2012

(30) Foreign Application Priority Data

Mar. 27, 2009 (GB) ..... 0905338.0

(51) Int. Cl.
*E21B 7/12* (2006.01)
*E21B 36/00* (2006.01)
(Continued)

(52) U.S. Cl.
CPC ..... *E21B 36/001* (2013.01); *E21B 43/01* (2013.01); *E21B 43/12* (2013.01); *F28D 1/022* (2013.01); *F28F 9/0275* (2013.01); *F28G 9/00* (2013.01)

(58) Field of Classification Search
USPC ..... 166/344, 351, 357, 302, 311, 75.12; 137/15.04, 15.05
See application file for complete search history.

(56) References Cited

U.S. PATENT DOCUMENTS 3,292,845 A 12/1966 Hens et al.
3,504,741 A * 4/1970 Talley, Jr. et al. ..... 166/356
(Continued)

FOREIGN PATENT DOCUMENTS

WO 2005/001368 A2 1/2005
WO 2005/026497 A1 3/2005
(Continued)

OTHER PUBLICATIONS

International Search Report from PCT/NO2010/000118 dated Feb. 16, 2011 (3 pages).
(Continued)

*Primary Examiner* — Matthew Buck
*Assistant Examiner* — Aaron Lembo
(74) *Attorney, Agent, or Firm* — Conley Rose, P.C.

(57) ABSTRACT

There is provided a subsea system for increasing pressure and/or flow rate in a flow line, the subsea system being arranged in fluid communication with said flow line which receives fluid from at least one fluid source. The subsea system comprises at least one compressor or pump and at least one subsea cooler which is arranged in the flow line in series with the at least one compressor. The subsea system further comprises a recirculation line which is configured such that at least a portion of the fluid flowing in the flow line downstream the at least one compressor and the at least one subsea cooler may be recirculated back to the flow line upstream the at least one compressor and the at least one subsea cooler such that the recirculating line can be used for capacity regulation of the at least one compressor and cleaning of the at least one subsea cooler. There is also provided a method for the removal of wax and/or hydrate and/or sand and debris which has accumulated in at least one subsea cooler of a subsea system.

21 Claims, 9 Drawing Sheets

Figure 1:
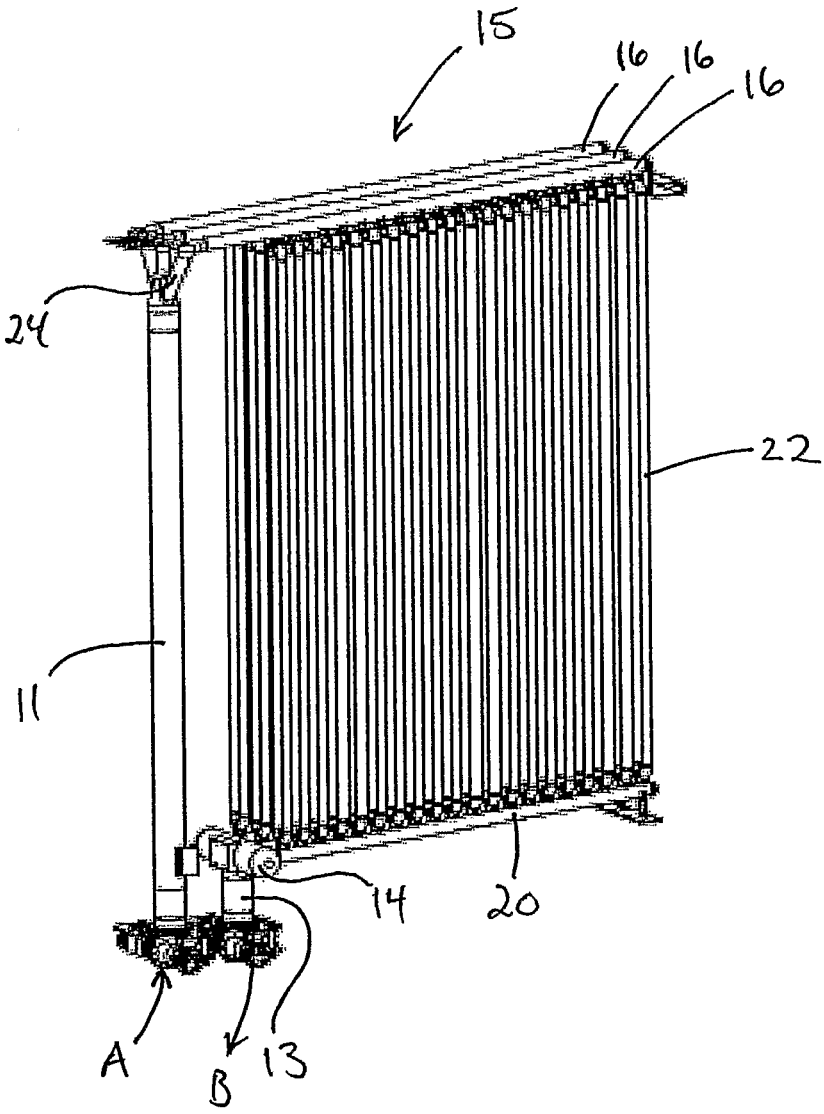

(51) Int. Cl.

| | |
|---|---|
| ***E21B 43/01*** | (2006.01) |
| ***E21B 43/12*** | (2006.01) |
| ***F28D 1/02*** | (2006.01) |
| ***F28F 9/02*** | (2006.01) |
| ***F28G 9/00*** | (2006.01) |

(56) References Cited

U.S. PATENT DOCUMENTS

| | | | | |
|---|---|---|---|---|
| 3,633,667 | A * | 1/1972 | Falkner, Jr. | 166/366 |
| 3,846,994 | A | 11/1974 | Reid | |
| 3,877,520 | A * | 4/1975 | Putnam | 166/366 |
| 4,281,716 | A * | 8/1981 | Hall | 166/339 |
| 4,375,835 | A * | 3/1983 | Archer | 166/339 |
| 4,490,073 | A * | 12/1984 | Lawson | 405/169 |
| 4,921,399 | A | 5/1990 | Lew | |
| 5,246,035 | A * | 9/1993 | Skyllingstad et al. | 137/625.31 |
| 5,836,167 | A * | 11/1998 | Clouston et al. | 62/66 |
| 6,079,498 | A * | 6/2000 | Lima et al. | 166/370 |
| 6,142,215 | A * | 11/2000 | Paulsen et al. | 165/45 |
| 6,655,155 | B2 * | 12/2003 | Bishop | 62/45.1 |
| 6,725,924 | B2 * | 4/2004 | Davidson et al. | 166/250.01 |
| 6,774,276 | B1 | 8/2004 | Lund et al. | |
| 7,093,661 | B2 * | 8/2006 | Olsen | 166/357 |
| 7,422,063 | B2 * | 9/2008 | Crichlow | 166/302 |
| 7,569,097 | B2 * | 8/2009 | Campen et al. | 95/243 |
| 7,703,535 | B2 * | 4/2010 | Benson | 166/368 |
| 7,798,233 | B2 * | 9/2010 | Daniel et al. | 166/363 |
| 7,819,950 | B2 * | 10/2010 | Stinessen et al. | 95/153 |
| 8,057,580 | B2 * | 11/2011 | Poorte et al. | 95/254 |
| 8,607,830 | B2 * | 12/2013 | White | 141/37 |
| 2002/0046773 | A1 * | 4/2002 | Bishop et al. | 137/259 |
| 2007/0029091 | A1 | 2/2007 | Stinessen et al. | |
| 2008/0087328 | A1 * | 4/2008 | Christensen et al. | 137/13 |
| 2008/0156035 | A1 | 7/2008 | Aspelund et al. | |
| 2009/0277612 | A1 * | 11/2009 | Poorte et al. | 165/104.21 |
| 2009/0314481 | A1 * | 12/2009 | Poorte | 165/184 |
| 2009/0321366 | A1 * | 12/2009 | Poorte | 210/747 |
| 2010/0206573 | A1 * | 8/2010 | Paulus et al. | 166/335 |
| 2010/0252227 | A1 * | 10/2010 | Sten-Halvorsen et al. | 165/45 |

FOREIGN PATENT DOCUMENTS

| | | | |
|---|---|---|---|
| WO | 2006/010771 | A1 | 2/2006 |
| WO | 2007/067059 | A1 | 6/2007 |
| WO | 2008/004882 | A1 | 1/2008 |
| WO | 2008/147219 | A2 | 12/2008 |

OTHER PUBLICATIONS

International Preliminary Report on Patentability from PCT/NO2010/000118 dated Sep. 13, 2011 (9 pages).

* cited by examiner

SUBSEA SYSTEM WITH SUBSEA COOLER AND METHOD FOR CLEANING THE SUBSEA COOLER

The present application relates to a subsea compressor/pump system, including a subsea cooler, for hydrocarbons, and a method for the removal of wax and/or hydrate which has accumulated in the subsea cooler.

Controlling the fluid temperature is important for the operation of a pump/compressor. A too high or too low process temperature may, depending on the actual fluid properties, possibly result in different problems (flow assurance issues).

Low temperature on the process side may cause hydrate formation and lead to waxing, scaling or to excessively high viscosities, hence reducing the pumpability/compressability of the fluid.

Normally, the solubility increases with increasing temperature (normal soluble), but a few salts, i.e. the inverse soluble salts, behave differently. These are typically salts having increasing solubility with increasing temperatures when the temperature is above a certain temperature (typically about 35° C. for $CaCO_3$). Below this temperature the solubility increases with increasing temperature until a certain temperature, above which the solubility again decreases with increasing temperature. The solubility also depends on for example the pressure and changes in pressure.

A low process temperature will be further lowered as the fluid flows through the subsea cooler. On the process side, normal soluble salts may therefore be deposited. On the seaside the water will be heated. Salts may therefore be formed on the seaside if the process temperature is sufficient to bring the surface above the inversion point for inverse soluble salts.

On the other hand, high temperatures on the process side can limit the use of a compressor/pump, or can lead to scaling (normal soluble salts) or cause scaling on ambient side.

Rapid temperature changes may potentially cause temperature differences between internal pump/compressor parts and housing which may affect the lifetime of the pump/compressor.

The issues above may be detrimental to the pump/compressors potential to enhance or maintain production.

US 2007/0029091, also published as WO 2005/026497, discloses a well flow which is allowed to be cooled down to the temperature of the ambient sea water before gas and liquid are separated. The dry gas will not precipitate free water and hydrates will therefore not be formed. The well stream is inhibited with MEG or another type of inhibitor to prevent hydrate formation. The recirculation line mentioned in this publication, is line for surge protection. A cooler may be installed in the recirculation line in which there is no need for active temperature control because the temperature of the fluid flowing in the recirculation line cannot go below the temperature of the surrounding sea water, and hence there is no danger of precipitation of free water and subsequent formation of hydrates.

It is the objective of the present invention to provide a subsea system including a subsea cooler wherein the formation of wax and/or hydrate in the subsea cooler can be managed.

It is further the objective of the present invention to provide a subsea system including a subsea cooler wherein the formation of wax and/or hydrate and accumulated sand and debris in the subsea cooler may be removed.

It is further the objective of the present invention to provide a subsea system including a subsea cooler wherein the capacity regulation of the subsea cooler is enhanced.

These objectives are achieved with a subsea system as defined in claim 1 and a method for the removal of wax and/or hydrate and sand and debris which has accumulated in the subsea cooler as defined in claim 13. Further embodiments of the invention are defined in the dependent claims.

A subsea system with a subsea cooler is provided where the combination of the subsea cooler and a recirculation line provide solutions or remedies to the challenges outlined above. Particularly wax removal and hydrate control will be described in more detail below. The disclosed subsea system with the subsea cooler is particularly suitable when the subsea cooler is an inline subsea cooler for wet gas applications, i.e. when the fluid flowing through the subsea cooler comprises water and hydrocarbons in gaseous form, and normally also liquid water and condensate, i.e. hydrocarbons in liquid form. Other potential functions based on the combination of a subsea cooler and a recirculation line is also included.

There are two alternative subsea cooler locations, which are principally different. The subsea cooler may be located in the main flow line, i.e. the pumped or compressed flow is always cooled, or the subsea cooler may be installed in a recirculation line, i.e. only cooling fluid flowing through the recirculation line.

Installing the subsea cooler in the recirculation line can be used for multiphase pumps while the inline subsea cooler, i.e. a subsea cooler installed in the main flow line, can be used for wet gas applications where the temperature rise across the compressor is larger and the benefits from reducing the suction temperature are more important.

There is provided a subsea system arranged in fluid communication with at least one flow line receiving fluid from at least one fluid source, the subsea system comprising at least one compressor or pump. The subsea system further comprises at least one subsea cooler which is arranged in the flow line upstream or downstream the compressor. Furthermore, the subsea system comprises a recirculation line configured such that at least a portion of the fluid flowing in the flow line downstream the at least one subsea cooler and the at least one compressor may be recirculated back to the flow line upstream the at least one subsea cooler and the at least one compressor.

In order to regulate the flow of fluid through the recirculation line, the recirculation line of the subsea system is preferably provided with at least one valve device which communicates with a control system which controls the valve device.

The fluid source may be one or more hydrocarbon wells producing well streams of hydrocarbons, which may include oil, gas, water and/or solid particles, flowing in flow lines. Two or more flow lines from different wells may be combined into a single flow line, and the well stream flowing in the flow line may be pumped by one or more compressors.

The subsea cooler preferably comprises at least two cooling sections where each cooling section comprises a plurality of cooling pipes configured to exchange heat with the surrounding sea water. The subsea cooler further comprises one or more valve devices such that the flow of fluid through the cooling sections can be independently regulated. The subsea cooler may be regulated such that the fluid may flow through one, some or all or none of the cooling sections. Obviously, the rate of fluid flow through the sections may be regulated in a continuous manner.

At least one of the cooling sections of the subsea cooler may be provided with one or more temperature sensors and/or one or more pressure sensors communicating with a control system including a control unit. The control unit controls the valve device or valve devices based on the values measured by the temperature sensor(s) and/or the pressure sensor(s) and/or other types of sensors, whereby the flow of fluid through the cooling sections may be regulated. Alternatively, the valve devices may be regulated manually, for example by using an ROV, based on readings of temperature and/or pressure and/or other physical quantities, or by using predetermined procedures. Furthermore, the fluid flow may be regulated on the basis of the temperature and/or the pressure of the fluid upstream and/or downstream the cooling sections of the subsea cooler.

The subsea system may be provided with temperature sensors measuring the discharge temperature of the fluid out of the subsea cooler and the temperature of the fluid upstream the subsea cooler whereby the temperature difference across the subsea cooler is be obtained. The subsea system may also be provided with pressure sensors measuring the discharge pressure of the fluid downstream the subsea cooler and the pressure of the fluid upstream the subsea cooler whereby the pressure difference across the subsea cooler is obtained. The pressure drop across the subsea cooler, possibly combined with pump/compressor suction temperature, may be used as a guide to when the subsea cooler needs cleaning.

As mentioned, the subsea system preferably communicates with a control system which regulates the subsea cooler's valve devices based on the measured temperature difference and/or pressure difference across the subsea cooler or measurement of other physical quantities related to the fluid flow through the subsea cooler. The same control system may be used to regulate the flow through the main flow line with the compressor, the recirculation line and the bypass line. Alternatively, the subsea system may be provided with one or more separate control unit(s) for this purpose. Obviously, one or more of the valve devices may be configured such that they are regulated manually, for example by using a ROV.

For removal of wax and/or hydrate which has accumulated in the subsea cooler, the fluid flow through at least one of the cooling sections is shut off, thereby reducing the cooling of the fluid and melting accumulated wax and/or hydrate, which has accumulated in the section or sections of subsea cooler which are open for fluid flow. As an alternative to shutting off the fluid flow through the cooling section or sections completely, the flow rate through the cooling section or sections may instead be reduced to a desired level.

This procedure may be repeated until all the sections of the subsea cooler which need cleaning have been cleaned, i.e. when one cooling section has been cleaned, the cooling section that was shut off can be reopened up for fluid flow and another section can be shut off. In the end, all the cooling sections will be cleaned.

There is also provided a method for the removal of wax and/or hydrate which has accumulated in the subsea cooler of the subsea system. At least a portion of the fluid flowing in the flow line downstream the compressor is recirculated through the recirculation line back to the flow line upstream the subsea cooler and the compressor, whereby the discharge temperature of the subsea cooler is increased and wax and/or hydrates which has accumulated is melted. The recirculation of fluid may also be combined with the shutting off of one or more of the cooling sections of the subsea cooler such that the temperature and the speed of flow of the fluid flowing through the cooling sections being cleaned, is further increased.

If it is desired to maintain natural production of fluid from the at least one fluid source, i.e. the well stream of hydrocarbons, during the cleaning of the subsea cooler, the produced fluid may be passed through the bypass line while the compressor is running at least partly in recirculation modus. Usually, routine cleaning via increased recirculation will lead to minimal or no change in the production of hydrocarbons. A full stop or a large reduction in production of hydrocarbons will only be carried out if the pressure in the module needs to be bled down via for example the downline or the flowline, alternatively by using the wet gas compressor and recirculation.

The required cooler capacity will depend on flow rates, arrival temperature at the subsea cooler and the compressor, required pressure increase, etc. Cooling to much can cause hydrate and wax deposits while cooling to little can reduce the feasibility of the system. The actual cooler capacity will furthermore depend on seasonal variations in the ambient temperature and draught.

Hydrates and/or wax may also be melted/removed by increasing the subsea cooler temperature for short periods by increasing the fraction of the pumped/compressed flow in recirculation.

Alternatively, the subsea cooler's capacity/performance may be regulated through adjusting the heat load by changing the fraction of the flow that is recirculated. Raising the temperature by adjusting the heat load may also be used to remove hydrates and/or wax.

Wax may over time deposit on the walls in the cooler reducing heat transfer performance and hence reduce the overall capacity of the subsea system. Preferably, the wax is removed by melting. This can be obtained by increasing the subsea cooler's discharge temperature. When required, the cooler discharge temperature may therefore be increased for a period of time by increasing the heat load of the subsea cooler, i.e. the fraction of the flow in recirculation is increased. This is obtained by adjusting the valve device in the recirculation line whereby the recirculation flow rate versus production flow rate is regulated. The same may be obtained by reducing the cooling area of the subsea cooler which will also give rise to an increased temperature in the subsea cooler.

A hydrate is a term used in organic and inorganic chemistry to indicate that a substance contains water. Hydrates in the oil industry refer to gas hydrates, i.e. hydrocarbon gas and liquid water forming solids resembling wet snow or ice at temperatures and pressures above the normal freezing point of water.

Hydrates frequently causes blocked flow lines with loss of production as a consequence. Hydrate prevention is usually done by ensuring that the flow lines are operated outside the hydrate region, i.e. insulation to keep the temperature high or through inhibitors lowering the hydrate formation temperature.

Figure 13:
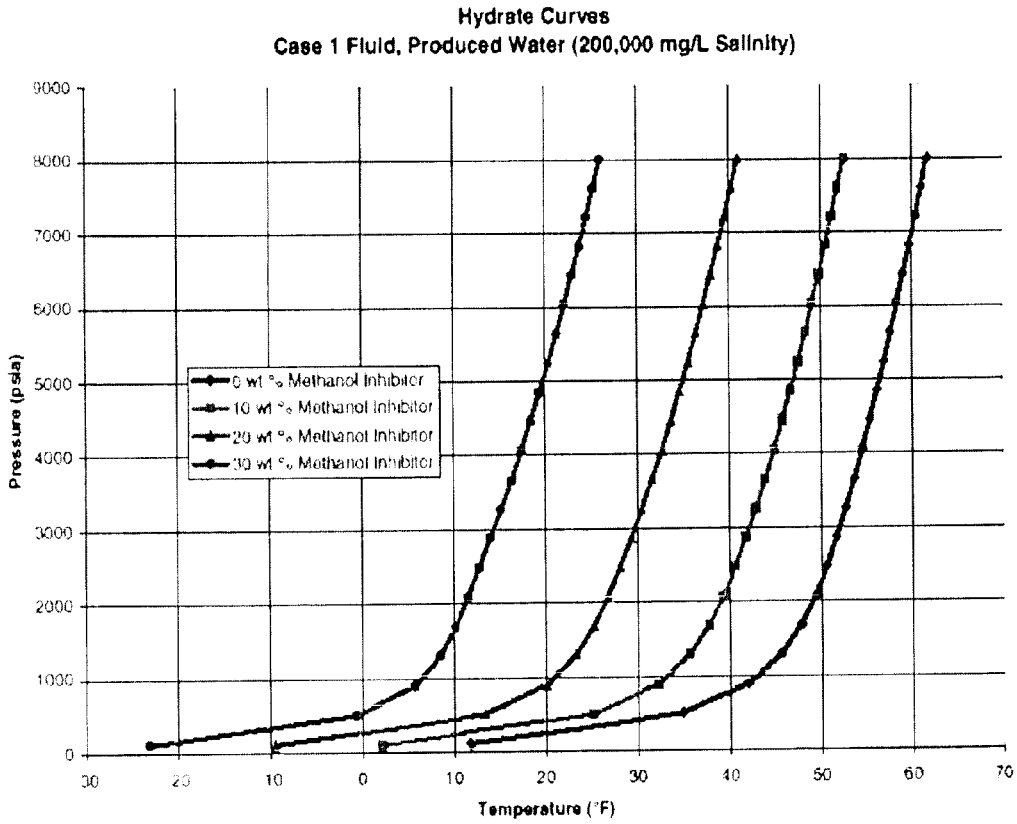

Referring to FIG. 13, typical hydrate curves are shown for uninhibited brine and for the same brine with various amounts of hydrate inhibitor. The content of methanol increases from the left to the right, i.e. the leftmost curve is the 0 wt % curve and the rightmost curve is the 30 wt % curve. The flow lines are operated on the right hand side of the curves, since hydrates cannot form on this side.

Hydrates, if formed, are usually removed through melting. The flow line is depressurised to bring the operating conditions outside the hydrate region (the hydrate region is on the left hand side of the curve) or the hydrate curve is depressed through using inhibitors. A frequent method for hydrate removal is hence to stop production and bleed down the flow lines in order to melt the hydrates through depressurizing. It is often in these cases deemed important to depressurize equally the hydrate plug, i.e. on both sides, to reduce some of the dangers connected with this process (trapped pressurised gas which may cause the ice plug to shoot out when the ice plug loosens).

Hydrates will, during operation, start to form if the process temperature falls below the hydrate formation temperature at the operating pressure. The temperature reduction across the subsea cooler can hence cause hydrates to form which, given time, may partly or completely block the cooling pipes or the compressor suction line.

It is usually required that the flow line is kept above the hydrate formation temperature for a prolonged time in case of a shut down in order to gain time to intervene to prevent hydrates to form. The subsea cooler being non-insulated will be a major cold spot in the system and is hence a potential problem area in a shut down scenario.

Therefore, it would be advantageous to have methods to prevent hydrates from forming and to obtain the required hold time in a shut down scenario. Furthermore, it would be advantageous to obtain a method to dissolve hydrates if the flow line and/or subsea cooler are partly or completely blocked.

During normal operation of the subsea cooler, the subsea cooler's discharge pressure and temperature can be measured as explained above. If the subsea cooler's discharge pressure and temperature indicates that the operating of the subsea cooler starts to close in on the hydrate region, the distance to the hydrate region may be increased by increasing the temperature through increasing the subsea cooler heat load. Obtain this functionality requires that the recirculation line is provided with a valve device such that the recirculation flow rate versus production flow rate may be adjusted.

Alternatively, the pressure in the compressor may be reduced by closing the isolation valves. The gas in the module will, as it will be trapped in the subsea cooler, be rapidly cooled down causing a pressure drop in the unit, hence increasing the margin towards the hydrate formation curve. For this purpose the module is preferably equipped with valves going to fail safe close in a shut down situation.

For hydrate removal, the pressure across the subsea cooler (which is the most likely hydrate location) may be equalized in combination with a pressure reduction by opening the recirculation line.

If the subsea cooler is still not completely blocked by hydrates, both sides of the hydrate plug sees the suction pressure of the compressor, and the pressure on both sides of the hydrate may be reduced by using the compressor in combination with the recirculation line to reduce the suction pressure in the subsea cooler. For example, if the pressure is 20 bara and the compressor works with a pressure ratio of 2, the suction pressure is reduced to 10 bara. Thereby, the hydrate may be melted without having to depressurise the whole flow line. The recirculation will also cause a temperature increase which will help melt the hydrate.

Alternatively, the hydrates, when the subsea cooler is only partly blocked, may be melted by using a combination of pressure reduction and/or temperature increase by running the compressor in recirculation mode. The suction pressure can often be lowered below the hydrate formation pressure by utilising the recirculation choke. The recirculated fluid temperature will likewise be raised when the compressor is running in recirculation mode as all the energy input from the compressor will have to be removed by the subsea cooler. Hydrates can thus be removed/melted without having to depressurize the flow lines and natural production can be maintained through the bypass line during the melting process. The method could with preference be combined with dehydrate inhibiting in order to enhance melting. It should be noted that any hydrates in the subsea cooler will be depressurized from both sides.

A method for early detection of fouling would also be beneficial. Fouling is a term used for any deposits, i.e. wax, scale, hydrates etc. on the process side and scale, marine growth etc. on the ambient side reducing the heat transfer between the fluid flowing through the subsea cooler and the sea water. An early indication of fouling can allow preventive measures to be taken.

This may be done by designing one or more parts of the subsea cooler as a cold and/or warm zone such that said parts will have a lower or higher temperature respectively than the rest of the subsea cooler, and furthermore, to measure the temperature in the dedicated part or parts and use the measurements to detect if the temperature in the subsea cooler is dropping towards a critical temperature for waxing, hydrates or inversely soluble salts (i.e. internal fouling).

The bulk fluid temperature entering or leaving the subsea cooler (or other type of equipment) can be measured and compared to the critical temperatures for hydrates, wax and scale. There may however be colder spots in the equipment causing the fluid to drop below the critical temperatures without it being detected by the bulk temperature measurement. This can, for the subsea cooler, be due to for instance small variations in fluid distribution across the unit.

An alternative method for obtaining early detection of fouling would therefore be to utilize measurements of differential pressure over a restriction in the cold and the warm zone respectively where the restrictions are employed to ensure equal fluid distribution to the individual cooling pipes. The relative change in pressure between the restrictions may be used to indicate whether the relative fluid flow through the cooling pipes has changed independently of changes in process temperature, sea temperature or sea currents. The same effect could also be achieved by using ultrasonic speed sensor, in which case there is no need for the restrictions. In fact, any sensor providing a signal relating to a physical quantity which changes when the flow rate changes, may be utilized to obtain an early detection of fouling.

A further alternative to detect fouling would be to use a gamma densitometer to measure the density in a cross section of cooling pipes such that it would be possible to discover hydrates being deposited on the wall of the cooling pipes or lumps of hydrates in the fluid flow etc.

Figure 2:
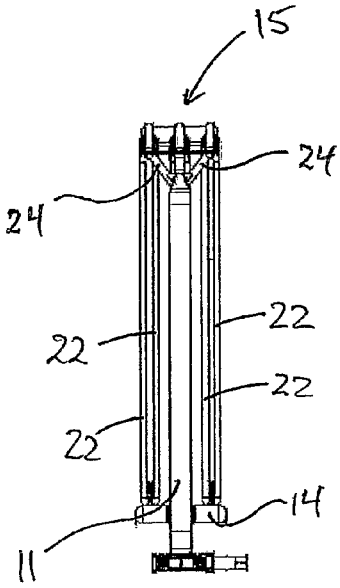
Figure 3:
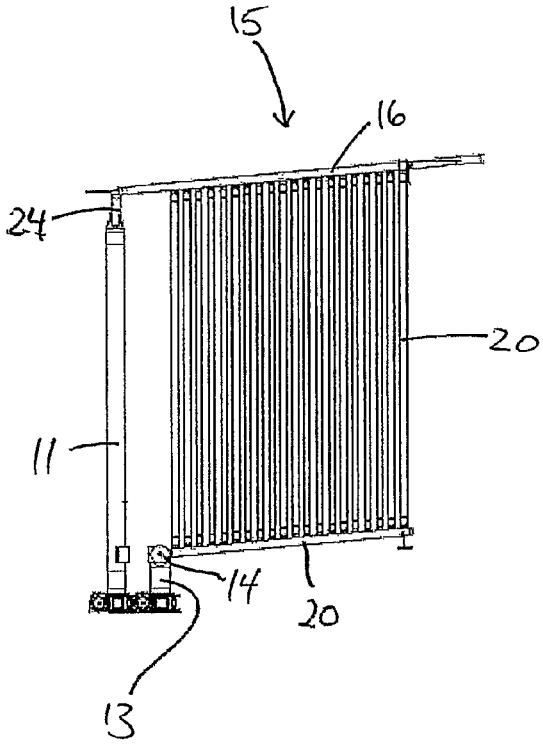
Figure 4:
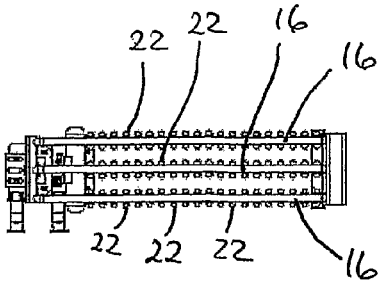
Figure 5:
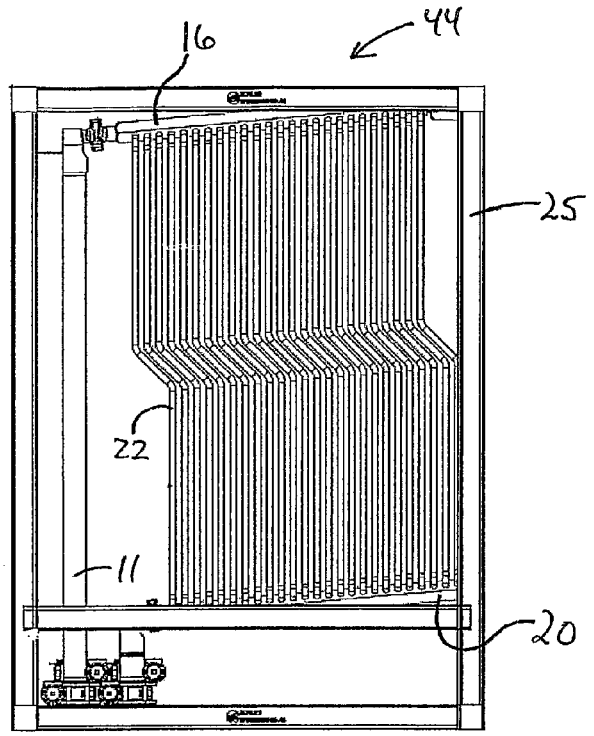
Figure 6:
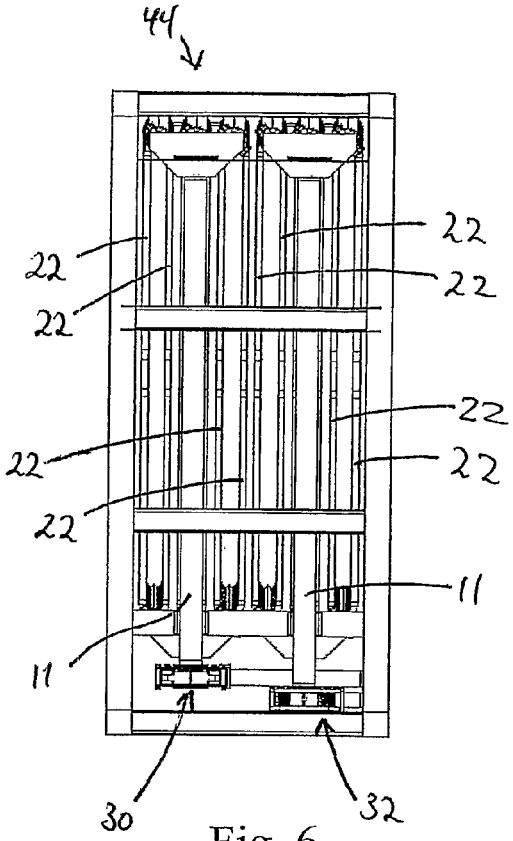
Figure 7:
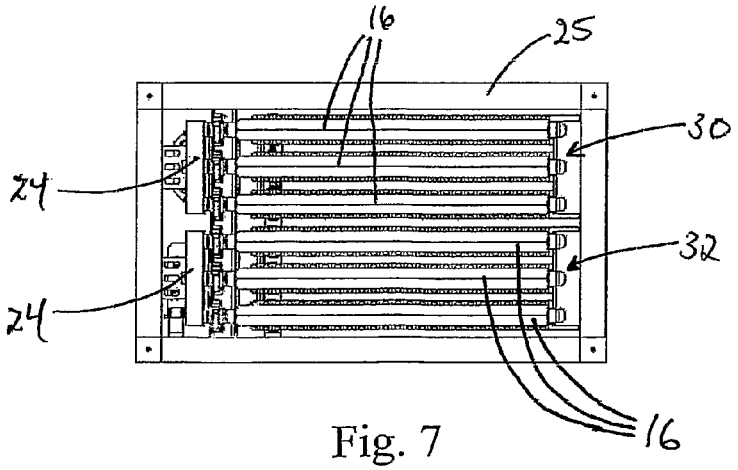
Figure 8:
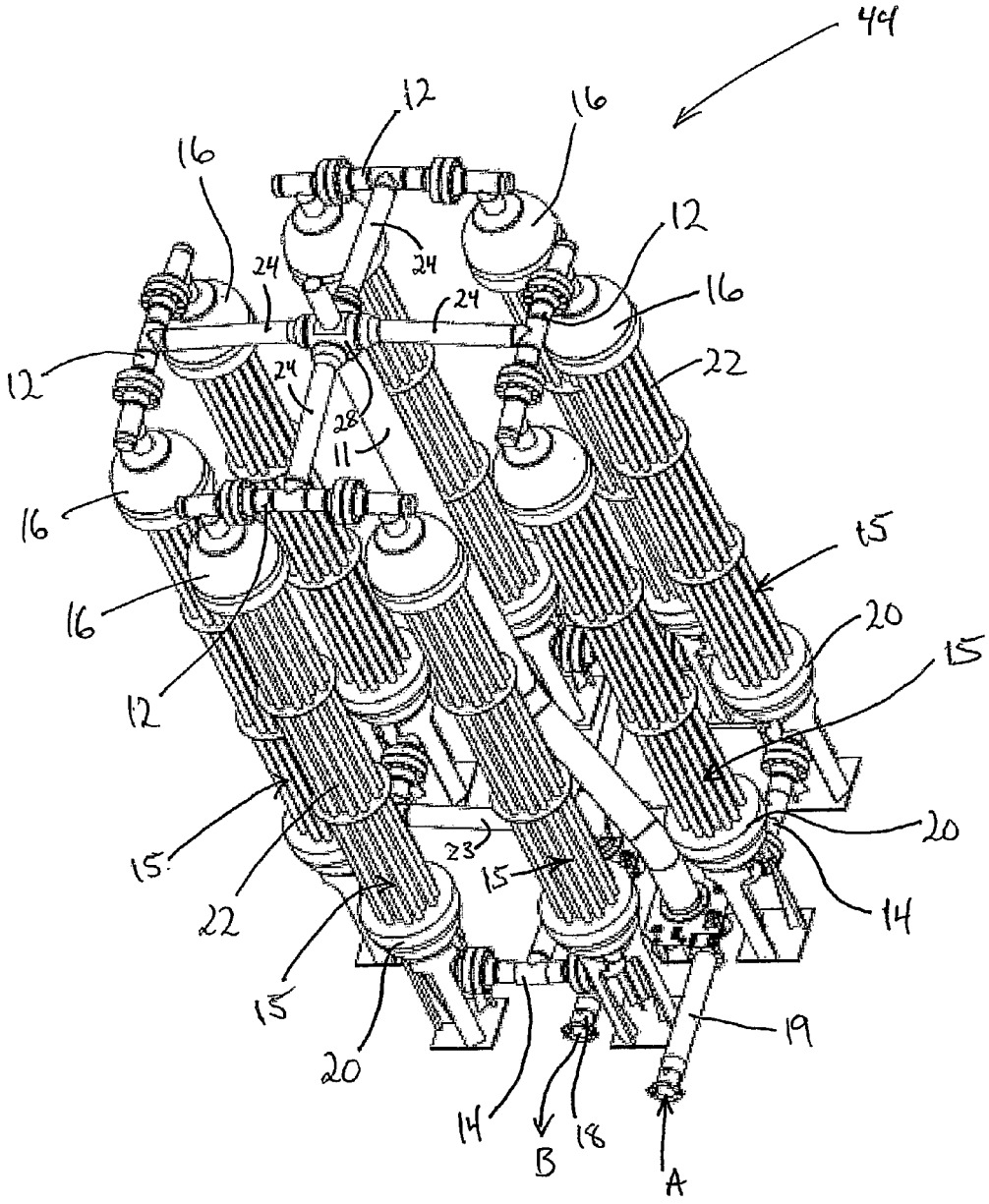
Figure 9:
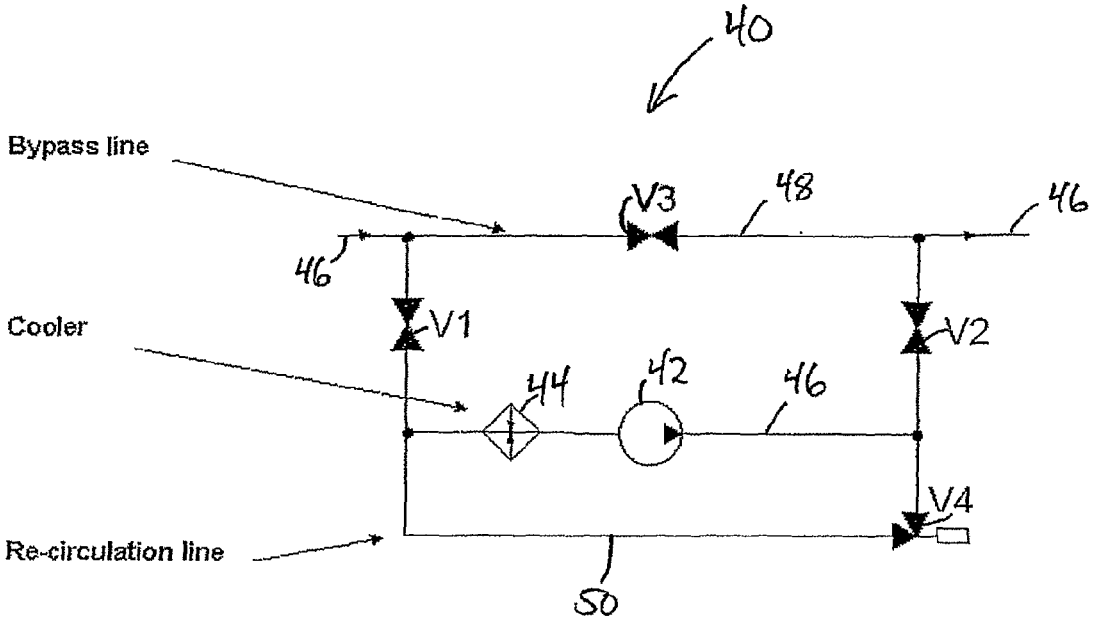
Figure 10:
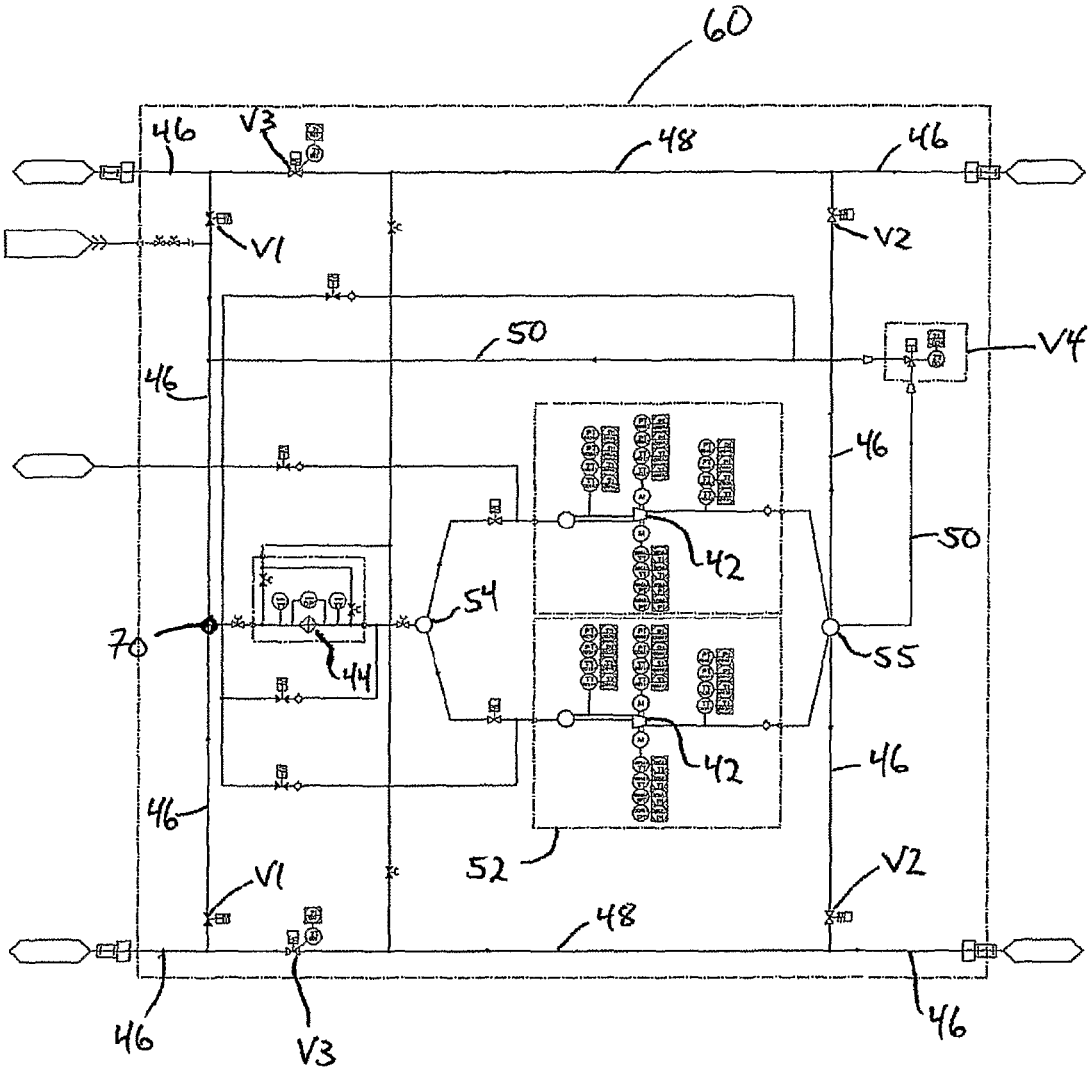
Figure 11:
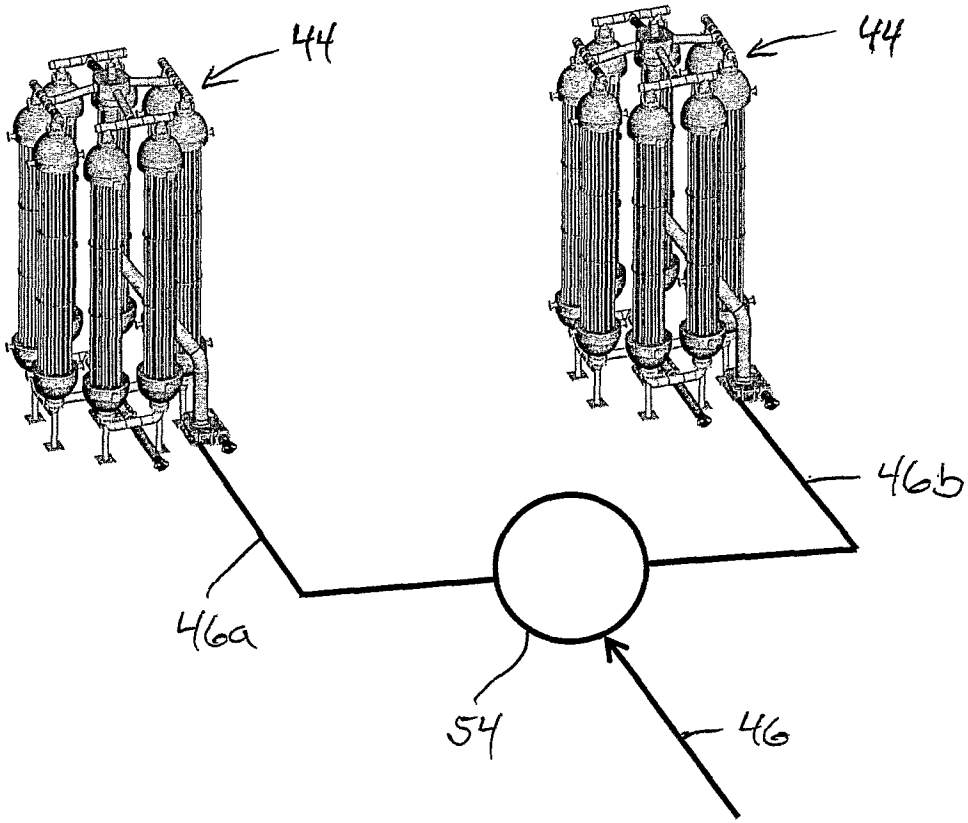
Figure 12:
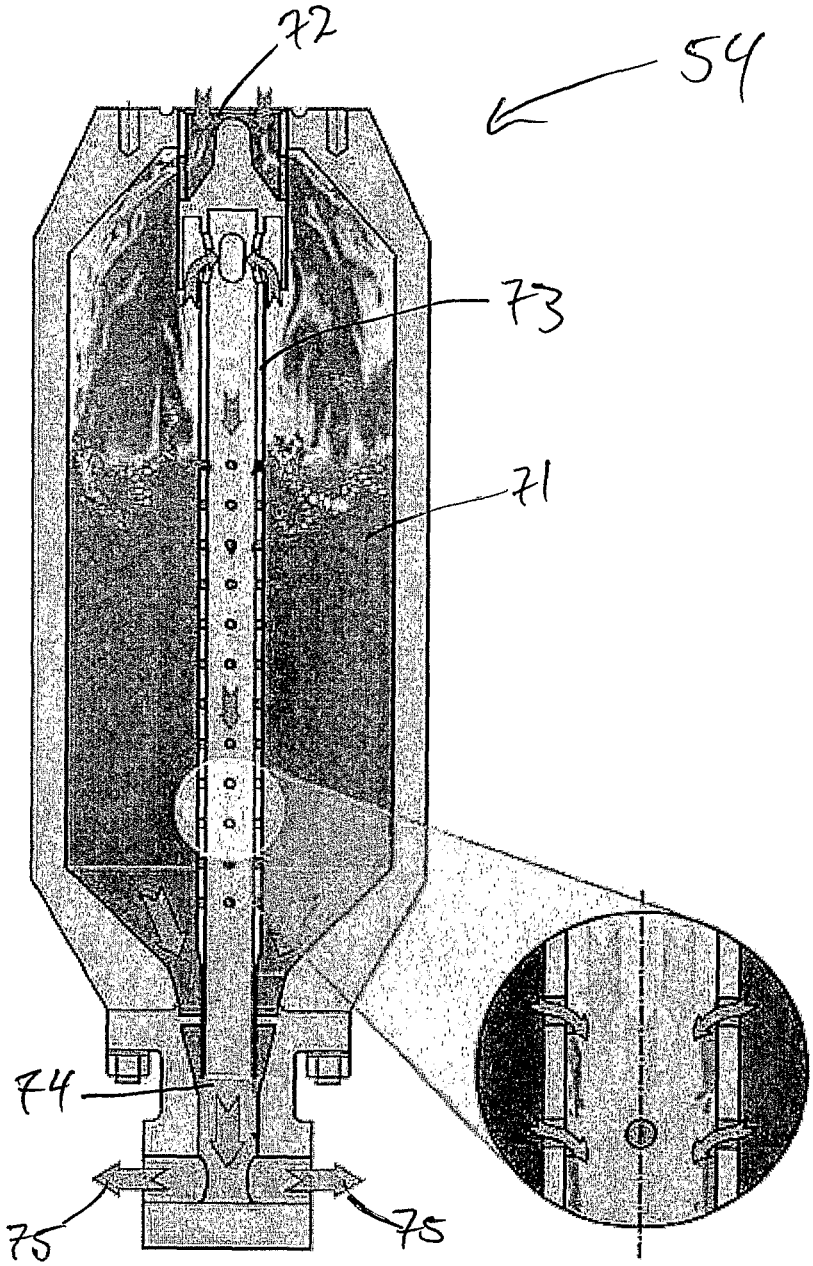

Preferred, non-limiting embodiments of the invention will now be explained with reference to the figures, where FIG. 1 shows a perspective view of a cooling section of a first subsea cooler, FIG. 2 shows a side view of a cooling section of a first subsea cooler, FIG. 3 shows a side view of a cooling section of a first subsea cooler, FIG. 4 shows a top view of a cooling section of a first subsea cooler, FIG. 5 shows a side view of a first subsea cooler, FIG. 6 shows a side view of a first subsea cooler, FIG. 7 shows a top view of a first subsea cooler, FIG. 8 shows a perspective view of a second subsea cooler, FIG. 9 shows a schematic view of a first embodiment of the subsea system, FIG. 10 shows a schematic view of a second embodiment of the subsea system, FIG. 11 shows a schematic view of a subsea system including two subsea coolers and a flow divider where the piping from the flow divider to the respective subsea coolers is symmetric, FIG. 12 shows a flow divider which is also capable of homogenizing the fluid flow and damping slugs in the fluid flow, FIG. 13 shows exemplary hydrate curves for uninhibited brine and for brine with various amounts of hydrate inhibitor.

In FIGS. 1-4 there is shown a cooling section 15 of the subsea cooler. The cooling section 15 comprises a riser pipe 11 with an inlet, indicated with the letter A, which may be connected to a flow line (not shown). To the riser pipe 11 there is mounted a distributing pipe 24, which divides the fluid flow in the riser pipe 11 into three branches. To each branch of the distributing pipe 24 there is connected an inlet manifold 16.

Similarly, the subsea cooler 10 comprises an outlet pipe 13, which is connected to a collecting manifold 14. To the collecting manifold there are connected three outlet manifolds 20 which are preferably located at a lower position than the inlet manifolds 16 when the subsea cooler is installed. As shown in the figures, the number of distributing manifolds 16 is equal to the number of collecting manifolds 20. This is, however, not necessary and one may for example imagine a cooling section 15 being provided with fewer outlet manifolds 20 than inlet manifolds 16.

Between the inlet manifolds 16 and the outlet manifolds 20 at least one, but preferably a plurality of cooling pipes 22 extend. The subsea cooler 10 is configured such that the cooling pipes 22 are exposed to the surrounding sea water under operating conditions and therefore the fluid flowing through the subsea cooler exchanges heat energy with the surrounding sea water.

As seen on FIGS. 1-4, the cooling pipes 22 are preferably configured such that they are substantially vertical when the subsea cooler 10 is installed and operating. The outlet manifolds 20 and the inlet manifolds 16 are preferably configured such that they are sloping or slanting relative to a horizontal plane. This is clearly shown in FIG. 3. Fluid flowing into the cooler, as indicated by arrow A in FIG. 1, will flow up through the riser pipe 11 and through the distributing piping 24 and thereafter the inlet manifolds 16. Then the fluid flows downward through the cooling pipes 22 and further through the slanting outlet manifolds 20 and collecting manifold 14, and finally out through the outlet pipe 13, as indicated by arrow B. The substantially vertical configuration of the cooling pipes 22 and the slanting configuration of the outlet manifold 20 and the inlet manifold 16 makes it easier to remove sand and debris from the subsea cooler 10.

In FIGS. 5-7 a subsea cooler 10 with two cooling sections is shown arranged in a frame 25. The subsea cooler 10 is provided with a first cooling section 30 and a second cooling section 32. Each cooling section 30, 32 is designed in the same way as the cooling section 15 disclosed in FIGS. 1-4, and is provided with distributing pipes 24 connected to three inlet manifolds 16 and outlet manifolds 20 connected to outlet pipes (not seen in the figures). Between the inlet manifolds 16 and corresponding outlet manifolds 20 there are provided at least one, but a preferably a plurality of cooling pipes 22 which, as shown, are configured to exchange heat energy with the surrounding sea water when the subsea cooler 10 is installed and in use.

Furthermore, the subsea cooler 10 is provided with one or more valve devices (not shown in the figures) which communicate with a control system which is capable of controlling the valve devices such that the flow of fluid through the cooling sections 30, 32 of the subsea cooler 10 may be controlled and regulated. By remote control of the valve device or valve devices, the fluid may be arranged to flow through both cooling sections 30, 32 or only one of the cooling sections, and the rate of fluid flow through any given cooling section 30, 32 may be adjusted to a desired level.

The subsea cooler 44 shown in the FIGS. 1-7 is configured with one or two cooling sections. The subsea cooler may, however, be provided with more than two cooling sections if so desired. Each cooling section could also be provided with more than three or less than three inlet manifolds 16 and outlet manifolds 20 as shown on the figures.

In FIG. 8 there is disclosed a second embodiment of the subsea cooler 44. Although the design is slightly different from the subsea cooler disclosed above, the subsea cooler 44 shown in FIG. 8 comprises the same main components as the subsea cooler disclosed in connection with FIGS. 5-7. The subsea cooler 44 comprises eight cooling sections 15. Each cooling section 15 comprises an inlet manifold 16 which is connected to the riser pipe 11 through a pipe 29, and an outlet manifold 20 which is connected to an outlet through outlet piping. Between the inlet manifold 16 and outlet manifold 20 of each cooling section 15 there is provided at least one, but preferably a plurality of cooling pipes 22. When the subsea cooler 44 is installed and in use, the fluid flows through the riser pipe 11. At the top, the fluid flows through four pipes 29 into the distributing manifolds 12 of the four cooling sections 15. Thereafter, the fluid flow is distributed to the two cooling section 15 and flows down through the cooling pipes 22 which are exposed to the surrounding sea water when the subsea cooler is installed. The subsea cooler 44 is preferably provided with one or more valve devices (not shown in FIG. 8) such that the fluid flow through the cooling sections 15, and possibly also each cooling tower 31 of the cooling sections 15, may be controlled and regulated independently of each other. The subsea cooler 44 is preferably also provided with a bypass line and a valve device for regulation of flow fraction through the subsea cooler 44.

In FIG. 9 there is shown an embodiment of a subsea system 40. The subsea system 40 comprises a flow line 46 in which a fluid is flowing. The fluid flow may be a mixture of water and hydrocarbons originating from a subsea well, like for instance a wet gas.

In the flow line 46 there is arranged a pump or a compressor 42 and upstream the compressor 42 a subsea cooler 44. The subsea cooler is preferably of a type as described above. Upstream the subsea cooler there is arranged a valve device V1 in the flow line 46, and downstream the compressor 42 there is arranged a valve device V2 in the flow line 46, both valve devices V1 and V2 preferably communicating with a control system such that the flow of fluid through the subsea cooler 44 and the compressor 42 in the flow line 46 may be controlled and regulated. It should be mentioned that under normal operating conditions the fluid flows through the flow line 46 and therefore passes through the subsea cooler 44 and subsequently the compressor 42. The subsea system is further provided with a recirculation line 50 through which at least a part of the fluid flowing in the fluid line 46 downstream the compressor 42 may be recirculated back to the fluid line 46 upstream the subsea cooler 44 as shown on FIG. 8 in FIG. 4. In the recirculation line 50 there is provided a valve device V4 which preferably communicates with a control system such that the fluid flow through the recirculation line 50 may be controlled and regulated. Furthermore, at the branching point 47, where the recirculation line 50 joins the flow line 46, there is preferably provided a mixer.

The mixer can be of the type shown in FIG. 12, which is capable of homogenizing the fluid flow and damping slugs in the fluid flow.

The subsea system may also be provided with a bypass line 48. In the bypass line 48 there is preferably arranged a valve device V3 which preferably communicates with a control system such that the fluid flow through the bypass line 48 may be controlled and regulated.

Fluid may flow through the subsea system shown in FIG. 8 as follows:

Well fluid flows naturally thought the open bypass valve device V3. The isolation valve device V1 and possibly V2 is shut. The pump/compressor is not in use.

Well fluid flows naturally through the open bypass valve device V3. One or more of the isolation valve devices V1, V2 may be closed. The recirculation valve device V4 is open and the pump or compressor 42 is running, thereby circulating fluid through the recirculation line 50.

The bypass valve device V3 is closed. The isolation valves devices V1, V2 are open. The well fluid is produced through the compressor 42. This is the normal configuration when the compressor 42 is running. A fraction of the compressor 42 flow may, depending on the position of the recirculation valve device V4, flow from the discharge side of the compressor 42 back through the re-circulation line 50 to the flow line 46 upstream the compressor 42 and the subsea cooler 44.

The bypass valve device V3 is closed. The wells are not free flowing. The pump or compressor 42 is running in recirculation mode, i.e. the recirculation valve device V4 is open, in order to lower the wellhead pressure, thereby "kicking off" the production. This mode will be followed by normal production through the pump or compressor 42 as described above.

A part of or all the pump/compressor power will, depending on the fraction of the fluid flow being recirculated, heat up the fluid in the module. The discharge temperature can hence, if not cooled, become so high that it will limit the use of the pump/compressor and eventually result in a system shut down. High suction temperatures will, for a compressor system furthermore reduce the overall efficiency. It is therefore favourable to install the subsea cooler 44 in the system to control the temperature.

The applicant's own mixer and splitter unit were originally developed to homogenise multiphase flow for the purpose of multiphase flow measurements and multiphase pump inlet conditioning. It has since then been applied to several other application areas where it is aimed for effective mass transfer such as water treatment, gas purification and gas dehydration.

Slug-flow into the cooler unit can have detrimental effects on the construction due to water hammering. If the above mentioned mixer is installed upstream the subsea cooler 44, it will dampen out axial flow variations (both changes in the instantaneous gas-liquid ratio and flow velocity) and in addition provide radial mixing enhancing the fluid distribution.

Furthermore, the applicant's mixer may be installed upstream two or more subsea cooler clusters operating in parallel. The mixer will then operate as a flow splitter providing, due to the flow out of the mixer being homogenous, a symmetric flow split hence ensure that each of the cooler clusters will have the same flow rate and hence the same cooling load. The flow splitter can hence be used in combination with a valve like device to provide cooling from one or more cooling clusters In FIG. 10, there is shown a subsea system 60 configured to receive a flow of fluid through two flow lines 46. In the flow line a compressor 52 is arranged comprising two compressors 42. Upstream the compressor 52 there is arranged an inline subsea cooler 44. The subsea system 60 further comprises a flow mixer 54 upstream the compressor 52 and downstream the subsea cooler 44, and a flow splitter downstream 55 down stream the compressor 52. The flow mixer 54 may also be provided upstream the subsea cooler 44.

In an alternative embodiment of the invention, the subsea system 60 is provided with two, or possible more, subsea coolers 44, preferably arranged in parallel, as shown in FIG. 11. The flow mixer 54 is preferably provided upstream the two subsea coolers 44, for example at a branching point 70 as indicated in FIG. 10, and will also act as a flow divider and as a damper of sluggish flow. The flow divider and mixer 54 will also homogenize the fluid flow and ensure an even distribution of fluid between the two subsea coolers 44 since the flow divider and mixer 54 ensures that liquid droplets are broken down into smaller droplets whereby an homogeneous multiphase flow is obtained before the fluid enters the subsea cooler or coolers 44.

In FIG. 11 there is shown such a subsea system which is provided two subsea coolers 10 arranged in parallel. The fluid flow in the fluid line 46 is preferably split evenly in two lines 46*a* and 46*b* between the two subsea coolers 44 by employing a flow divider 54 which provides an even distribution of gas and liquid in the fluid flow. Furthermore, the flow divider is preferably arranged such that a symmetric piping 46*a*, 46*b* from the flow divider to the subsea coolers is obtained.

There is also provided a recirculation line 50 extending from a flow splitter 55 downstream the at least one compressor 42 and subsea cooler 44 back to the flow line 46 upstream the subsea cooler 44 and the compressor 42, as can be seen in FIG. 10. The recirculation line 46 is provided with a valve device V4 which regulates the flow of fluid through the recirculation line 46.

Each of the flow lines 46 are provided with a bypass line 48 such that the well fluid from each flow line 46 may bypass the compressor 52. The bypass lines 48 are both provided with a valve device V3 which control the flow of fluid through their respective bypass lines 48.

Each of the flow lines 46 are also provided with a valve device V1 upstream the inline subsea cooler 44 and each of the flow lines 46 are provided with a valve device V2 downstream the compressor 52 and also downstream the flow splitter 55. The valve devices V1, V2 regulates the flow of fluid in the flow line 46 through the subsea cooler 44 and the compressor 52.

Fluid flows through the dual pump/compressor in the same way as for the single pump/compressor shown in FIG. 8 FIG. 4 and explained above.

Well fluid flows naturally thought one or both of the open bypass valve device(s) V3. The isolation valve device(s) V1, and potentially V2, is(are) shut. The pump/compressor is not in use.

Well fluid flows naturally through the open bypass valve devices V3. One or more of the isolation valve devices V1, V2 may be closed. The recirculation valve device V4 is open and at least one of the pump/compressors 52 are running circulating fluid through the recirculation line 50.

The bypass valve devices V3 are closed. The isolation valves devices V1, V2 are open. The well fluid is produced through the compressor 52. This is the normal configuration when the compressor 52 is running. A fraction of the fluid flowing through the compressor 52 may, depending on the position of the recirculation valve device V4, flow from the flow splitter 55 downstream the compressor 52 back through the recirculation line 50 to the flow line 46 upstream the subsea cooler 42 and the compressor 52.

The bypass valves V3 are closed. The wells are not free flowing. The compressor 52, i.e. at least one of the pumps/compressors 42, is running in recirculation mode in order to lower the wellhead pressure, hence "kicking off" the production. This mode will be followed by normal production through the compressor 52 as described above.

In FIGS. 9 and 10 the subsea cooler or coolers are shown arranged upstream the at least one compressor or pump. It would also be possible to arrange the subsea cooler 10 downstream the at least one compressor or pump. In either case, the recirculation line 50 is connected to the flow line 46 upstream the subsea cooler 44 and the at least one compressor 42 and downstream the subsea cooler 44 and the at least one compressor 42.

In FIG. 12 an example of a flow divider 54 is shown. In addition to splitting the flow evenly, this flow divider also provides axial and radial damping of the fluid flow before splitting it. The flow divider 54 comprises a chamber 71 with an opening 72 where the fluid enters. In the chamber 71 there is provided a perforated pipe 73 which is arranged such that the gas flows through it. The perforated pipe 73 preferably extends down to the remixing zone 74 at the lower end of the chamber where the gas fraction and the liquid fraction is remixed. Below the remixing zone 74 there is preferably provided a restriction or nozzle means (not shown in the figure) which is designed such that the jets from the nozzle or restriction creates turbulent shear layers and atomizes the flow. The fluid 75 leaving the flow divider 54 is thereby provides an improved distribution of the gas and the liquid in the fluid flow before entering the subsea coolers 44 of the subsea system.

The invention claimed is:

1. A subsea system for increasing pressure or flow rate in a flow line that receives fluid from at least one fluid source, the subsea system in fluid communication with said flow line, the subsea system comprising:

a compressor or pump;

a subsea cooler, wherein the compressor or pump and the subsea cooler are arranged in the flow line in series;

a recirculation line configured to recirculate at least a portion of the fluid in the flow line downstream the compressor or pump and the subsea cooler to the flow line upstream the compressor or pump and the subsea cooler, wherein a flow through the recirculation line is configured to be altered to regulate capacity of the compressor or to clean the subsea cooler; and a bypass line configured to allow at least a portion of fluid to bypass the subsea cooler and the compressor or pump.

2. The subsea system according to claim 1 further comprising: a mixer on the upstream side of the subsea cooler.

3. The subsea system according to claim 1 further comprising: a mixer on the upstream side of the at least one compressor or pump and downstream side of the subsea cooler.

4. The subsea system according to claim 1, wherein the recirculation line comprises at least one valve device to regulate flow of fluid through the recirculation line.

5. The subsea system according to claim 1, wherein the bypass line comprises at least one valve device to regulate flow of fluid through the bypass line.

6. The subsea system according to claim 1, wherein the subsea cooler comprises a first and second cooling section and a valve device to independently regulate flow of fluid through the cooling sections.

7. The subsea system according to claim 1 further comprising a second subsea cooler and a flow divider upstream from the subsea coolers or the compressor or pump, the flow divider configured to split the fluid flow into two equal parts that are distributed through piping to the subsea coolers.

8. The subsea system according to claim 7, wherein the piping from the flow divider to the subsea coolers or the compressor or pump is symmetrically arranged.

9. The subsea system according to claim 7, wherein the flow divider is configured to homogenize the fluid flow and to dampen slugs in the fluid flow.

10. The subsea system according to claim 1 further comprising: a control system to control a position of a valve device in the subsea system to regulate the flow of fluid through the flow line, recirculation line, or bypass line.

11. The subsea system according to claim 1, wherein the fluid is a multiphase fluid comprising hydrocarbons or water.

12. The subsea system according to claim 6 further comprising:

a sensor upstream from the subsea cooler and a sensor downstream from the subsea cooler, wherein the upstream and downstream sensors measure the same physical quantity; and a control system to control a position of the valve device to independently regulate flow of fluid through the cooling sections, wherein the control system is configured to receive data from the upstream and downstream sensors and adjust the position of the valve device based on the data from the upstream and downstream sensors.

13. The subsea system according to claim 12 where the physical quantity is one of temperature or pressure.

14. The subsea system according to claim 12 wherein the control system is configured to adjust the position of the valve device based on a difference between a value represented by the data from the upstream sensor and a value represented by the data from the downstream sensor.

15. The subsea system according to claim 14 wherein the difference indicates that the subsea cooler requires cleaning and the control system adjusts the valve device to permit flow through the second cooling section and shut off flow to the first cooling section, and, subsequently, adjust the valve device to permit flow through the first cooling section and shut off flow to the second cooling section.

16. A method for the removal of wax, hydrate, sand, or debris from a subsea cooler of a subsea system, the subsea cooler comprising at least two cooling sections, the subsea system comprising a compressor or pump in series with the subsea cooler, the subsea system in fluid communication with a flow line receiving fluid from a fluid source such that fluid, under normal operating conditions, flows through the subsea cooler and the compressor or pump, the method comprising:

recirculating, through a recirculation line, at least a portion of the fluid in the flow line downstream the compressor or pump and the subsea cooler to the flow line upstream the compressor or pump and the subsea cooler;

maintaining natural production of fluid from the fluid source through a bypass line that bypasses the subsea cooler and the compressor or pump while recirculating fluid through the recirculation line, the compressor or pump, and the subsea cooler; and reducing a pressure in the subsea cooler such that hydrates in the subsea cooler are melted; or shutting off flow to one of two cooling sections of the subsea cooler, thereby reducing the cooling area of the subsea cooler and increasing the velocity or the temperature of the fluid flow through the subsea cooler.

17. The method according to claim 16 further comprising maintaining partial or full production of fluid from the fluid source through the compressor or pump while recirculating fluid through the recirculation line or when one or more cooling sections are shut off.

18. A subsea system for controlling wax or hydrates, the subsea system comprising:

a flow line;

a compressor or pump in the flow line;

a subsea cooler arranged in the flow line in series with the compressor or pump, the subsea cooler including a first cooling section, a second cooling section, a discharge temperature and a valve device;

a recirculation line configured to recirculate at least a portion of the fluid in the flow line downstream the compressor or pump and the subsea cooler to the flow line upstream the compressor or pump and the subsea cooler;

a bypass line configured to allow at least a portion of fluid to bypass the subsea cooler and the compressor or pump; and a control system configured to control the cooler valve device to reduce a flow rate in one of the cooling sections thereby increasing the discharge temperature.

19. The subsea system of claim 18 further comprising a recirculation valve device, and wherein the control system is configured to control the recirculation valve device to recirculate fluid at the increased discharge pressure to the subsea cooler at the reduced flow rate.

20. A subsea system for controlling wax or hydrates, the subsea system comprising:

a flow line;

a compressor or pump in the flow line;

a subsea cooler arranged in the flow line in series with the compressor or pump;

a recirculation line configured to recirculate at least a portion of the fluid in the flow line downstream the compressor or pump and the subsea cooler to the flow line upstream the compressor or pump and the subsea cooler;

a recirculation valve device;

a bypass line configured to allow at least a portion of fluid to bypass the subsea cooler and the compressor or pump; and a control system configured to control the recirculation valve device to open the recirculation device and reduce a suction pressure in the subsea cooler.

21. The subsea system of claim 20 wherein the recirculated fluid is recirculated through the subsea cooler at the reduced suction pressure.

* * * * *